United States Patent [19]

Kitamura et al.

[11] 4,398,949

[45] Aug. 16, 1983

[54] METHOD FOR STABLY REFINING HIGH CARBON STEEL

[75] Inventors: Minoru Kitamura, Nishinomiya; Shinji Koyama; Shuzo Ito, both of Kobe; Masahiko Ohgami, Kakogawa; Hideaki Fujimoto, Akashi, all of Japan

[73] Assignee: Kabushiki Kaisha Kobe Seiko Sho, Kobe, Japan

[21] Appl. No.: 315,888

[22] Filed: Oct. 28, 1981

[30] Foreign Application Priority Data

Dec. 18, 1980 [JP] Japan ..... 55-179887

[51] Int. Cl.[3] ..... C21C 5/34

[52] U.S. Cl. ..... 75/60; 75/59

[58] Field of Search ..... 75/59, 60

[56] References Cited

U.S. PATENT DOCUMENTS 3,854,932 12/1974 Bishop ..... 75/60

OTHER PUBLICATIONS

63rd National Open Hearth and Basic Oxygen Steel Conference Proceedings, vol. 63, Washington, D.C. Meeting, Mar. 23–26, 1980, The Iron & Steel Society of the American Institute of Mining, Metallurgical and Petroleum Engineers, pp. 131–139.

Development of Top- and Bottom-Blown Refining Process, by Yoshiharu Iida (Member) Committee 19, (Steelmaking), Subcommittee 3, Japan Society for the Promotion of Science, Sep. 26, 1980.

*Primary Examiner*—P. D. Rosenberg

*Attorney, Agent, or Firm*—Oblon, Fisher, Spivak, McClelland & Maier

[57] ABSTRACT

A method for stably refining high carbon steel by top and bottom blown converter refining in which the entire quantity or part of refining pure oxygen is blown onto molten iron through a top blowing lance nozzle while blowing an inert gas into the converter through a nozzle at the bottom thereof, and wherein the bottom blown inert gas is fed at a rate less than 0.09 $Nm^3$/min-ton during the blowing and/or at a rate less than 0.03 $Nm^3$/min·ton in a controlling stage immediately after turndown.

5 Claims, 9 Drawing Figures

METHOD FOR STABLY REFINING HIGH CARBON STEEL

BACKGROUND OF THE INVENTION

1. Field of the Invention

This invention relates to a method for refining high carbon steel by top and bottom blown process, and more particularly to improvements in and relating to the production of high carbon steel with 0.3% or more C-content by the top and bottom blown refining method in which pure refining oxygen is blown against the surfaces of molten iron through a top blowing lance nozzle while an inert gas is blown into the molten iron through a nozzle at the bottom of a furnace for stirring the melt.

2. Description of the Prior Art

In refining iron, the main trend in the current steelmaking industry is toward the LD converter using top-blown pure oxygen. In this connection, however, various studies have been developed and devoted to a top and bottom blown refining method incorporating the characteristics of the bottom blown oxygen process. According to this method, the entire amount or major portion of pure oxygen which is to be used for refining molten iron is blown against the surfaces of the molten iron through an oxygen blowing lance in a manner similar to the LD converter, while an inert gas is blown in through a gas blowing nozzle (or a tuyere) which is provided at the bottom of the converter, solely or along with slight amounts of oxygen and cooling gas. The latter is usually called "bottom blown gas" and serves to improve the metallurgical reactions to a considerable degree by its function of stirring and strengthening the molten iron and slag.

Although the flow rate of the bottom blown gas is extremely small as compared with that of the top blown gas, the method has the advantage that the refining speed can be controlled over a wide range by adjusting the oxygen flow rate by the top blown gas or the height of the blowing lance, due to its excellent refining reaction characteristics. The flow rate of the bottom blown gas itself is an important factor which largely influences the precision of the control of the refining process. However, no knowledge has been brought to the attention of those skilled in the art with regard to its influences or possibilities of improvement of the high carbon steel except that a greater flow rate of the bottom blown gas is reflected by a reduced O-content and an increased Mn-content in the steel and smaller (T.Fe) contents in the slag as obtained at turn down. Further, there have been provided no feasible data with respect to the kind of bottom blown gas and the bottom blowing of part oxygen gas which may cause a substantial change in the control of the refining process.

SUMMARY OF THE INVENTION

With the foregoing in view, the present invention contemplates achieving high accuracy of the iron refining process by restricting the flow rate of the bottom blown gas to an optimum range in a top and bottom blown converter using Ar, $N_2$ or like inert gas as a bottom blown gas.

As a result of analytical studies on the effect of the bottow blown gas flow rate on the metallurgical reactions in low carbon steels with less than 0.3% C-content and in high carbon steel with more than 0.3% C-content, it has been found that, for improvement of the metallurgical reactions in high carbon steel, the flow rate of the bottom blown gas in the refining process should be less than 0.09 $Nm^3$/min·ton, in contrast to the low carbon steel refining process. Further, in the case of the high carbon steel, there often occurs abnormal forming to slag immediately after turn down, frequently causing the problem of slopping a large amount of slag from the furnace. Such slopping or spitting should be absolutely avoided since it will not only invite reductions in the yield of the steel product and variations in its composition but also jeopardize the safety of the stationed worker. The present inventors have also conducted extensive studies in this regard and succeeded in establishing safe operating conditions in the high carbon steel refining process. More particularly, it has been found that the above-mentioned problem can be avoided by adjusting the bottom blown gas flow rate to less than 0.03 $Nm^3$/min·ton, preferably to less than 0.02 $Nm^3$/min·ton in the controlling stage subsequent to turn down.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein:

FIGS. 6 to 9 each illustrate a blowing nozzle in section, of which FIGS. 6 and 7 show examples of a nozzle which is unsuitable for application and FIGS. 8 and 9 illustrate suitable examples.

DETAILED DESCRIPTION OF THE PREFERRED EMBODIMENT

As mentioned hereinbefore, the improvement of the metallurgical characteristics is enhanced as the flow rate of the bottom blown inert gas is increased. This effect is conspicuous generally in the production of low carbon steel but has been considered to act adversely in the case of high carbon steel. More particularly, since it has been possible to reduce the (T.Fe) contents in the turn down slag in the production of high carbon steel using the conventional LD-converter process, the achievement of a higher dephosphoriation rate is more difficult as compared with the low carbon steel. Therefore, the introduction of the top and bottom blown converter into the high carbon steel refining process can contribute to enhancement of the oxygen efficiency for decarburization all the more by the increased stirring effect as compared with an ordinary LD-converter, and to reduce further the (T.Fe) contents in the turn down slag while making it difficult to achieve a high dephosphorization ratio.

Figure 1:
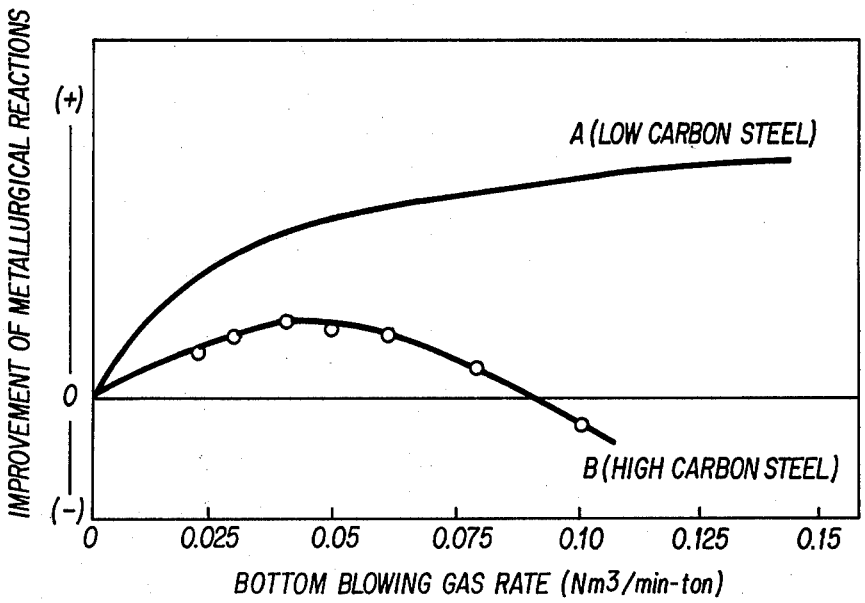
FIG. 1 is a diagram showing the inert gas blowing rate and its metallurgical reaction improving effect.

Plotted in the diagram of FIG. 1 are the trends of the effect of the bottom blown gas on the improvement of the metallurgical reactions, namely, on the reduction of the (T.Fe) contents in the turn down slag and the reduction of the O-content and the increase of Mn-content of the steel in the refining processes of typical low and high carbon steels. In this figure, reference characters A and B denote the trends for the low carbon steel and high carbon steel, respectively. Especially in the latter case, the metallurgical reaction improving effect is expressed in terms of the dephosphorizing characteristics, and there is employed a bottom blown gas flow pattern of constant rate to effect constant flow stirring. Looking first at the plot of the low carbon steel, it is determined that the improvement of the metallurgical reactions is enhanced remarkably with increases in the bottom blown gas flow rate until a level of 0.045 $Nm^3$/min·ton is reached. Even in the flow rate range beyond that level, increases in the improving effect can be traced though in a small degree. On the other hand, in the case of the high carbon steel, slight improvement of the dephosphorization characteristics is recognized at a bottom blown gas flow rate lower than 0.045 $Nm^3$/min·ton, contrary to the above-mentioned phenomenon, and this effect can be stabilized by suitably adjusting the top blowing conditions, especially, the oxygen flow rate and the height of the lance, thus allowing for dephosphorization characteristics which excel the LD-converter (bottom blown gas flow rate=0). However, with a bottom blown gas flow rate in excess of 0.045 $Nm^3$/min·ton, the dephosphorization characteristics begin to drop under the influence of the effect of reducing (T.Fe) contents in the slag, restoring the dephosphorization level of the LD-converter at the flow rate of 0.09 $Nm^3$/min·ton. Thereafter, it becomes lower than that of the LD-converter. As determined from these data, the bottom blown gas flow rate in the high carbon refining process should be held to be less than 0.09 $Nm^3$/min·ton and preferably should be a constant gas flow stirring rate in the range of 0.03–0.06 $Nm^3$/min·ton.

Figure 2:
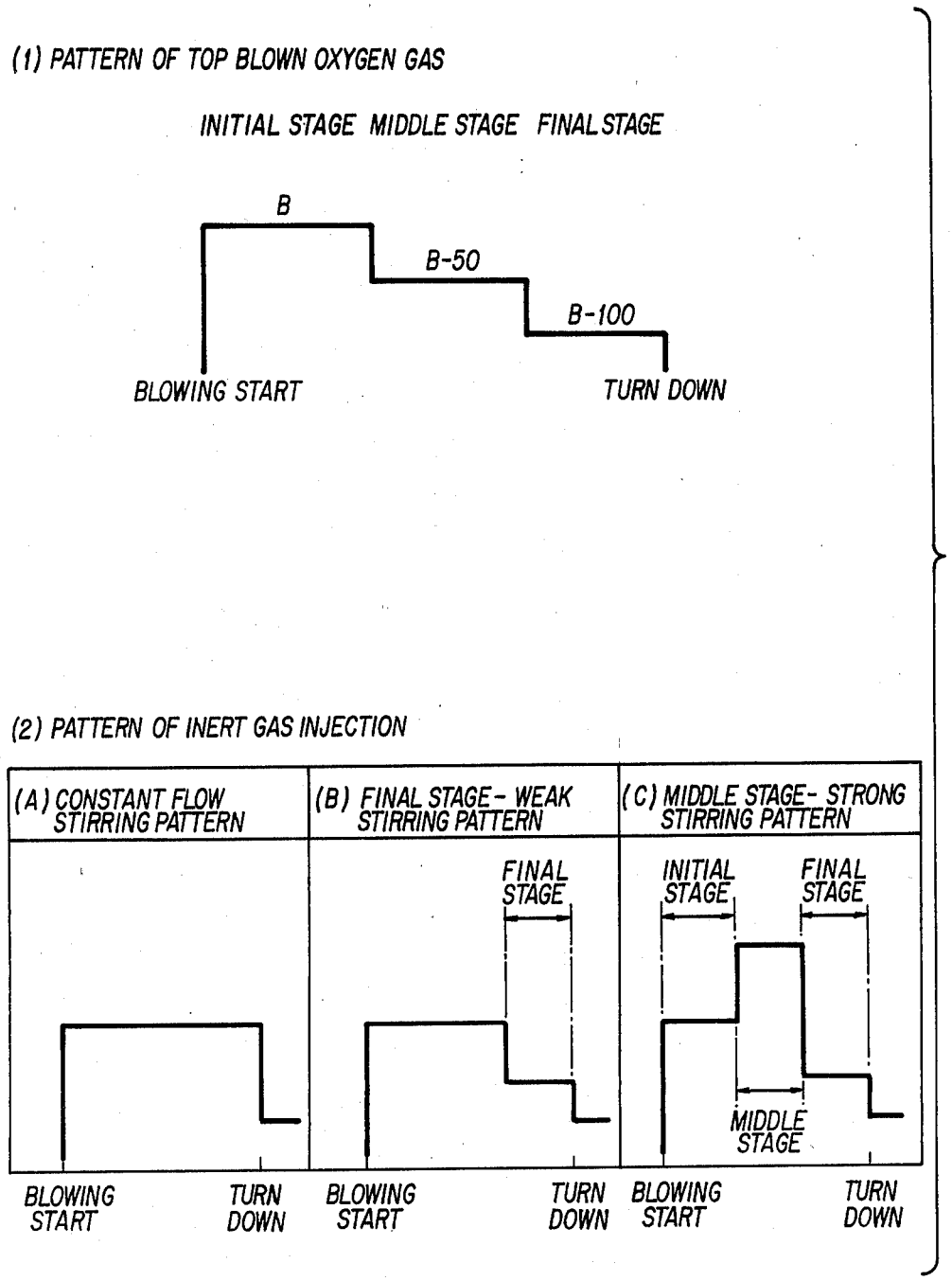
FIG. 2 is a diagram showing examples of a pattern of the top blown oxygen flow rate and a pattern of the bottom blown inert gas flow rate.

However, when the stirring due to the bottom blown gas is used in combination, reductions in the (T.Fe) contents invariably occur due to the strengthened mixing and stirring effects. Therefore, in order to produce high carbon steel according to severe dephosphorization standards, it is necessary to raise the degree of oxidation of the slag to the level of the top blown converter. For this purpose, the influence of the bottom blown gas on the stirring characteristics was studied by employing two other bottom blown gas flow patterns in addition to the above-mentioned constant flow stirring pattern, as shown in FIG. 2.

In the constant flow stirring pattern (A), a flow rate in the range of 0.03–0.06 $Nm^3$/min·ton is selected in view of the high dephosphorization rate as shown by the data of FIG. 1. In the final stage-weak stirring pattern (B) which aims to increase the (T.Fe) contents of the slag by the drop of flow rate in the final stage of the refining process, a flow rate in the range of 0.03–0.06 $Nm^3$/min·ton is selected in the initial and middle stages, while selecting for the final stage a flow rate in the range of 0.02–0.04 $Nm^3$/min·ton, namely, the minimum flow rate range in which the influence of back-attack is ignorable. The middle stage-strong stirring pattern (C) employs strong stirring in the middle stage of the refining process where the slag has a higher viscosity, lowering the flow rate in the final stage to increase the (T.Fe) content of the slag. More particularly, the pattern (C) employs flow rates of the ranges similar to pattern (B) in the initial and final stages, while selecting for the middle stage a flow rate in the range of 0.04–0.07 $Nm^3$/min·ton which is free of the slopping or spitting problems. Moreover, the following satisfied relation is recognized concerning about the gas flow rate of each stage in the flow stirring pattern (B) and (C), that is, $$Q_1 = Q_2 < Q_3 \text{ in the pattern (B)}$$

$$Q_2 > Q_1 > Q_3 \text{ in the pattern (C),}$$

wherein the characters $Q_1$, $Q_2$ and $Q_3$ are the gas flow rate in the initial stage, middle stage and final stage, respectively.

Figure 3:
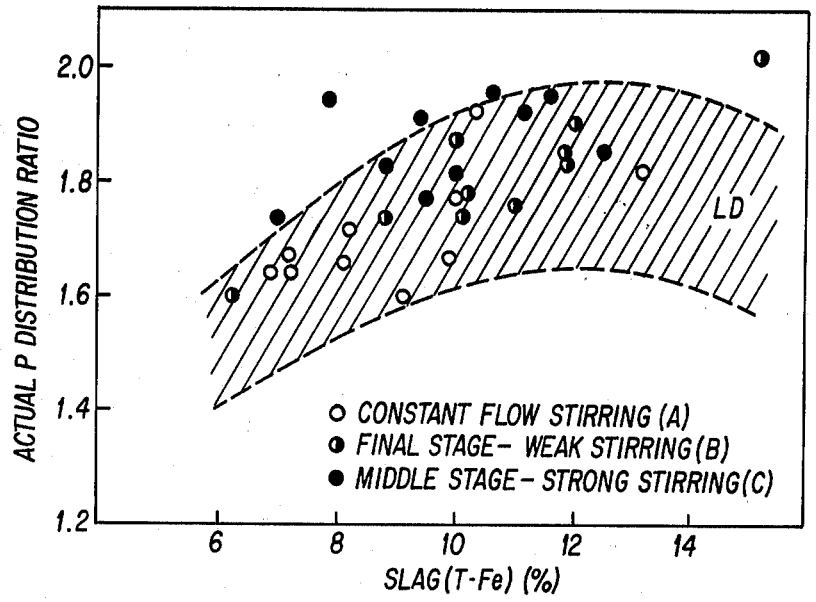
FIGS. 3 and 4 are diagrams showing the dephosphorization equilibrium in those cases where three different bottom blowing patterns are applied.
Figure 4:
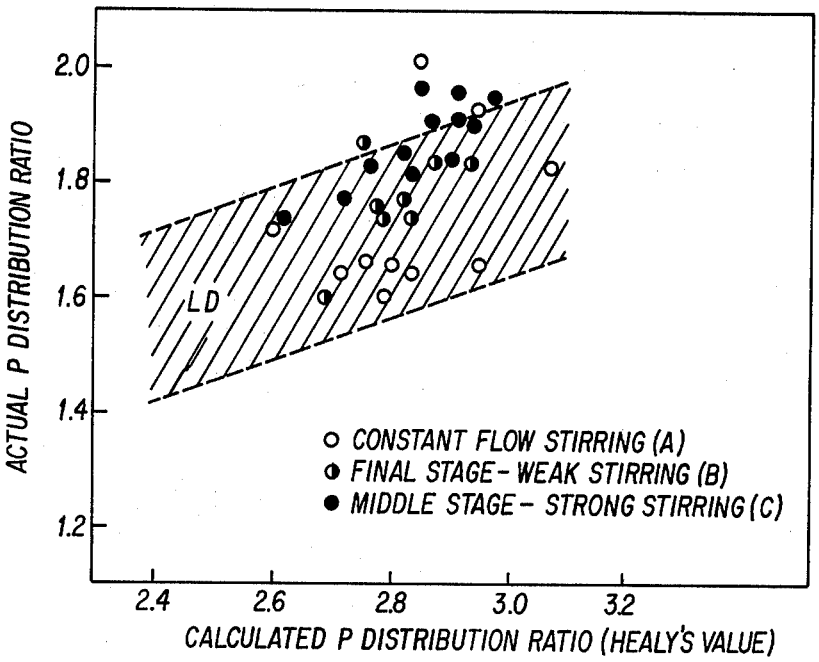

The diagrams of FIGS. 3 and 4 show the relationship of the actual phosphorous distribution ratio with the slag (T.Fe) and the dephosphorization in the refining processes using the respective bottom blown gas flow patterns. Upon judging on the same (T.Fe) level, it will be seen that the top and bottom blown method is improved in dephosphorization as compared with the ordinary LD-converter method (the hatched area). The dephosphorization is especially improved and the slag content (T.Fe) is shifted to a higher level in the order of patterns (A), (B) and (C).

The comparison of the operating characteristics of the respective patterns reveals that the patterns (B) and (C) have a trend toward active slag forming in the final stage of the refining process and this trend is conspicuous especially in pattern (C). Presumably, a soft blow condition is created in pattern (B) in the final stage of the refining process with lowered stirring and mixing actions between the slag and metal due to reductions in both top and bottom blown gas flow rates, and as a result, increasing the degree of oxidation of the (T.Fe) contents of the slag. On the other hand, in the case of pattern (C) with the maximum (T.Fe) content of the slag, the improvement of the dephosphorization capacity is considered to be attributable to the higher degree of oxidation of the slag which is attained by the strong stirring in the middle stage of the refining process.

Figure 5:
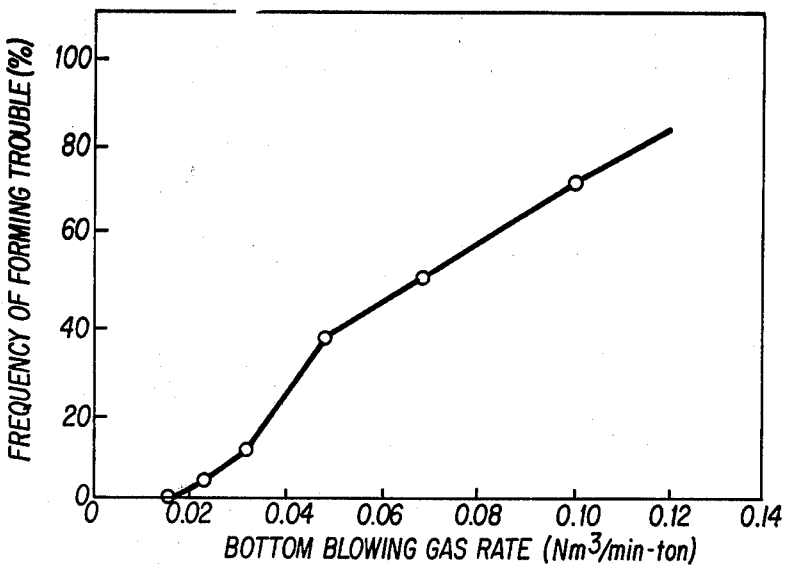
FIG. 5 is a diagram showing the bottom blown gas flow rate in relation to the abnormal slag forming.

The foregoing data indicates that stable production of high carbon steel with a reduced phosphorous content is possible by selecting an appropriate bottom blown gas flow rate in the refining process of the steel. More particularly, in the production of high carbon steel, the metallurgical reactions can be improved to a significant degree by holding the bottom blown inert gas flow rate below 0.09 $Nm^3$/min·ton in the top and bottom blown refining process, while lowering the phosphorous content by employing a bottom blown gas flow pattern which encourages slag oxidation, thus attaining the primary object of the invention. Nevertheless, a study of the abnormal slag foaming has also been conducted, a problem which is encountered peculiarly in the production of high carbon steel immediately after turn down as mentioned hereinbelow. FIG. 5 illustrates the results of such study, showing the frequency of abnormal slag forming in relation with the inert gas blowing rate in the controlling stage subsequent to the refining process. As seen therefrom, in order to eliminate the slag forming problems, it is preferred to reduce the flow rate of the bottom blown gas in the controlling stage preferably to a value less than 0.02 $Nm^3$/min·ton or at most less than 0.03 $Nm^3$/min·ton. Consequently, the bottom blown gas flow rate in the refining process of high carbon steel is preferably held below 0.09 $Nm^3$/min·ton, immediately dropping it in the succeeding controlling stage to a value below 0.03 $Nm^3$/min-ton or a value which can cope with the static pressure of the molten steel.

Figure 6:
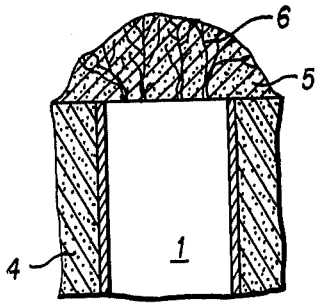
FIG. 6 PRIOR ART
Figure 7:
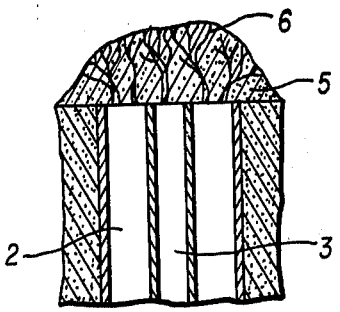
FIG. 7 PRIOR ART
Figure 8:
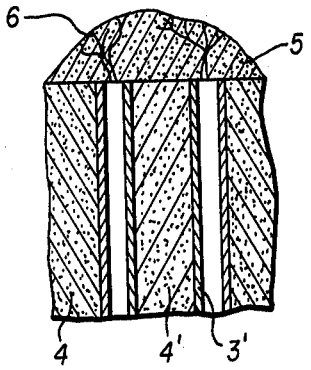
Figure 9:
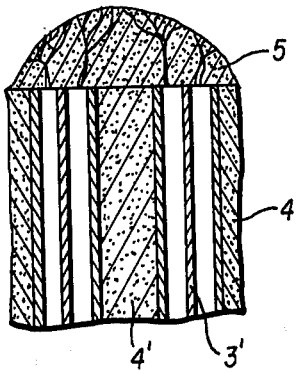

It has been revealed that the conventional single-pipe nozzle (FIG. 6) or double-pipe nozzle (FIG. 7) is unsuitable for controlling the gas flow rate precisely at such a low level. In these Figures, denoted by reference number 1 is a nozzle, by 2 an outer nozzle, by 3 an inner nozzle, by 4 refractory walls of the converter, by 5 a block matrix which is generally referred to as "mushroom", and by 6 narrow degassing passages. The nozzles of the constructions shown in FIGS. 6 and 7 have to be provided in a somewhat large size in order to secure required mechanical strength although relatively large bubbles are fed into the molten iron. Therefore, it is difficult to reduce the blow-in rate itself, and the bubbles which have been injected into the molten iron tend to form downward flows, making vigorous back-attacks against the refractory wall occur around the nozzle. FIGS. 8 and 9 illustrate a nozzle of a single annular pipe and a nozzle of a double-walled annular pipe, respectively, which permit control of the inert gas blow-in rate accurately at low levels and reduction of the back-attacks to a considerable degree for protection of the refractory walls. In these figures, indicated by reference number 4' is a refractory material which is closingly filled in an inner pipe 3' of the nozzle. Although the use of an annular nozzle of such construction facilitates practice of the method of the present invention, it should be noted that the invention is not restricted by the shape or construction of the nozzles illustrated.

According to the method of the present invention as described above, the metallurgical reactions in an LD-converter is improved significantly by the combined use of the bottom blowing no matter whether the metallurgical reactions are of low/medium carbon steels or high carbon steels, and the abnormal slag forming which takes place in the high carbon steel refining process is eliminated. Thus, the present invention greatly contributes to the utilization of the top and bottom blown refining processes.

Obviously, numerous modifications and variations of the present invention are possible in light of the above teachings. It is to be understood, therefore, that within the scope of the appended claims, the invention may be practiced otherwise than as specifically described herein.

What is claimed as new and desired to be secured by Letters Patent of the United States is:

1. A method for stably refining high carbon steel by top and bottom blown converter refining utilizing a converter, a top blowing lance nozzle and a nozzle at the bottom of the converter, which comprises:

blowing refining pure oxygen onto molten iron through said top blowing lance nozzle;

simultaneously blowing an inert gas into the converter through said nozzle at the bottom thereof wherein said blowing of inert gas further comprises feeding the bottom blown inert gas at a rate less than 0.09 $Nm^3$/min·ton during blowing of said inert gas; and subsequently feeding the bottom blown inert gas at a rate less than 0.03 $Nm^3$/min·ton during a controlling stage subsequent to the blowing of said inert gas.

2. A method as set forth in claim 1, wherein said feeding of bottom blown inert gas further comprises feeding said inert gas at a rate in the range of 0.03 to 0.06 $Nm^3$/min·ton during blowing of the inert gas.

3. A method as set forth in claim 1, wherein said feeding bottom blown inert gas further comprises feeding said inert gas at a rate less than 0.02 $Nm^3$/min·ton in said controlling stage subsequent to the blowing of said inert gas.

4. A method as set forth in claim 1, wherein said feeding of bottom blown inert gas further comprises feeding said inert gas at a rate in the range of 0.03 to 0.06 $Nm^3$/min·ton in initial and middle stages of blowing of the inert gas and at a rate in the range of 0.02 to 0.04 $Nm^3$/min·ton in a final stage of blowing of the inert gas, wherein the inert gas flow rate of each stage satisfies the relationship of $Q_1=Q_2>Q_3$, wherein $Q_1$, $Q_2$ and $Q_3$ are the inert gas flow rates of initial, middle and final stages of blowing of the inert gas, respectively.

5. A method as set forth in claim 1, wherein said feeding of bottom blown inert gas further comprises feeding said inert gas at a rate of 0.03 to 0.06 $Nm^3$/min-ton in an initial stage of blowing of the inert gas, at a rate of 0.04 to 0.07 $Nm^3$/min·ton in a middle stage and at a rate of 0.02 to 0.04 $Nm^3$/min·ton in a final stage, wherein the inert gas flow rate of each stage satisfies the relationship of $Q_3<Q_1<Q_2$, wherein $Q_1$, $Q_2$ and $Q_3$ are the inert gas flow rates of initial, middle and final stages of blowing of the inert gas, respectively.

* * * * *

UNITED STATES PATENT AND TRADEMARK OFFICE

CERTIFICATE OF CORRECTION

PATENT NO. : 4,398,949

DATED : AUGUST 16, 1983

INVENTOR(S) : KITAMURA, MINORU; NISHINOMIYA; KOYAMA, SHINJI; ITO, SHUZO; KOBE

It is certified that error appears in the above-identified patent and that said Letters Patent is hereby corrected as shown below:

In column 1, line 50, delete "(T.Fe)" and insert therefor --(T·Fe)--;

In column 1, line 65, delete "bottow" and insert therefor --bottom--;

In column 2, line 54, delete "(T.Fe)" and insert therefor --(T·Fe)--;

In column 2, line 64, delete "(T.Fe)" and insert therefor --(T·Fe)--;

In column 3, line 2, delete "(T.Fe)" and insert therefor --(T·Fe)--;

In column 3, line 31, delete "(T.Fe)" and insert therefor --(T·Fe)--;

In column 3, line 41, delete "(T.Fe)" and insert therefor --(T·Fe)--;

In column 3, line 56, delete "(T.Fe)" and insert therefor --(T·Fe)--;

In column 3, line 66, delete "(T.Fe)" and insert therefor --(T·Fe)--;

In column 4, line 17, delete "(T.Fe)" and insert therefor --(T·Fe)--;

UNITED STATES PATENT AND TRADEMARK OFFICE

CERTIFICATE OF CORRECTION

PATENT NO. : 4,398,949

DATED : AUGUST 16, 1983

INVENTOR(S) : KITAMURA, MINORU; NISHINOMIYA; KOYAMA, SHINJI; ITO, SHUZO; KOBE

It is certified that error appears in the above-identified patent and that said Letters Patent is hereby corrected as shown below:

In column 4, line 19, delete "(T.Fe)" and insert therefor --(T·Fe)--;

In column 4, line 24, delete "(T.Fe)" and insert therefor --(T·Fe)--;

In column 4, line 35, delete "(T.Fe)" and insert therefor --(T·Fe)--;

In column 4, line 37, delete "(T.Fe)" and insert therefor --(T·Fe)--;

In column 4, line 54, delete "foaming" and insert therefor --forming--;

Signed and Sealed this

Tenth Day of April 1984

[SEAL]

*Attest:*

GERALD J. MOSSINGHOFF

*Attesting Officer*

*Commissioner of Patents and Trademarks*